US006810802B2

(12) United States Patent
Huang

(10) Patent No.: US 6,810,802 B2
(45) Date of Patent: Nov. 2, 2004

(54) TAPE DISPENSER HAVING PRINTING MEANS FOR PRINTING THE TAPE BEING DISPENSED

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 0 days.

(21) Appl. No.: 10/301,622

(22) Filed: Nov. 22, 2002

(65) Prior Publication Data

US 2004/0045460 A1 Mar. 11, 2004

(51) Int. Cl.[7] ..... B41K 1/22
(52) U.S. Cl. ..... 101/328; 101/219
(58) Field of Search ..... 101/219, 216, 101/213, 212, 226, 288, 328, 327

(56) References Cited

U.S. PATENT DOCUMENTS 3,678,848 A * 7/1972 Roser et al. ..... 101/125
3,988,987 A * 11/1976 Ikura et al. ..... 101/327
5,197,386 A * 3/1993 Lin ..... 101/213
5,303,648 A * 4/1994 Shih ..... 101/329
5,577,444 A * 11/1996 Toyama ..... 101/379
5,732,627 A * 3/1998 Imamaki ..... 101/328
5,743,185 A * 4/1998 Hippely et al. ..... 101/327
5,784,959 A * 7/1998 Larios ..... 101/219
5,947,025 A * 9/1999 Huang ..... 101/327
6,170,395 B1 * 1/2001 Lee ..... 101/288
2002/0062752 A1 * 5/2002 Clarke ..... 101/375

* cited by examiner

*Primary Examiner*—Anthony H. Nguyen
(74) *Attorney, Agent, or Firm*—Bacon & Thomas, PLLC

(57) ABSTRACT

A tape dispenser. The dispenser includes a printing device for printing the tape being dispensed, a main body holding a tape roll holder, a printing wheel, a tape cutter, and an ink supply unit. The printing wheel has a cylindrical base made of hard material, and protruded portions protruded from the periphery of the cylindrical base and forming a printing surface around the periphery of the cylindrical base and coaxial to the cylindrical base. The ink supplying unit has a housing detachably mounted on the main body for receiving ink therein. A porous ink soaking layer is mounted inside the housing and adapted to soak the ink, and a fabric ink applying layer is covered on the porous ink soaking layer and partially exposed to, the outside of the housing and in contact with the printing surface of the printing wheel.

9 Claims, 6 Drawing Sheets

TAPE DISPENSER HAVING PRINTING MEANS FOR PRINTING THE TAPE BEING DISPENSED

BACKGROUND OF THE INVENTION

1. Field of the Invention

The present invention relates to tape dispensers and, more specifically, to a tape dispenser having printing means for printing the tape being dispensed.

2. Description of the Related Art

U.S. Pat. Nos. 5,947,025 and 6,112,659 respectively disclose a tape dispenser capable of printing patterns and words on the tape dispensed thereby and an adhesive tape dispenser provided with means for printing adhesive tape being dispensed. When the adhesive tape applied to the carton or the like, it seals the carton and, simultaneously provides a marking or advertising effect. The sprinting wheels of the aforesaid two U.S. patents (the member referenced by 30 in U.S. Pat. No. 5,947,025 and the member referenced by 40 in U.S. Pat. No. 6,112,659) are, as shown in FIG. 1, commonly comprised of a hard wheel body A (generally molded from plastics) and a flexible printing plate B (generally made of rubber). The flexible printing plate B has patterns and words formed thereon and, is adhered to the periphery of the wheel body A. Alternatively a packing strip (not shown) may be used to fasten the ends of the flexible printing plate B to the periphery of the wheel body A.

These two printing wheel designs have numerous drawbacks as outlined hereinafter.

1. Because the flexible printing plate is adhered to the periphery of the wheel body or fastened thereto by a packing strip, it tends to be forced out of the wheel body.
2. The flexible printing plate may be not smoothly evenly covered on the periphery of the hard wheel body, resulting in poor printing quality.
3. Due to technique limitations, sufficient space must be left in the four sides of the top surface of the rectangular flexible printing plate around the patterns and words during formation of the patterns and words. When the flexible printing plate rolled up into a roll around the periphery of the wheel body, a big blank area is left around the abutted ends of the flexible printing plate. The installation of the packing strip also requires a big blank area around the abutted ends of the flexible printing plate. When continuously circulating the printing on the adhesive tape being dispensed, an interrupted blank area appears on the adhesive tape being dispensed at every unit distance (the packing strip may produce an ink trace on the adhesive tape being dispensed). On the other words, cannot print a continuous series of patterns and words without leaving a trace of the ends of the flexible printing plate.
4. Because the flexible printing plate is made of rubber, the printing surface of the patterns and words tends to be deformed when contacting the underside of the adhesive tape being dispensed, resulting in a vague printing quality. Due to the aforesaid drawbacks, the prior art designs are not suitable for printing fine patterns and fine words.

Further, the aforesaid two prior art designs commonly have an ink supplying device (commonly referenced by 50). According to these two U.S. patents, the ink supplying device comprises an ink storage cassette (referenced by 55 in U.S. Pat. No. 5,947,025, or 51 in U.S. Pat. No. 6,112,659), and a roller-like ink soaking member (referenced by 56 in U.S. Pat. No. 5,947,025, or 53 in U.S. Pat. No. 6,112,659) made of sponge and fastened rotatably with the ink storage cassette. The roller-like ink soaking member soaks up ink from the ink storage cassette, and keeps the periphery in close contact with the printing plate of the printing wheel. When the printing wheel rotated by the tape being dispensed, the roller-like ink soaking member is rotated to apply ink to the printing surface of the printing plate of the printing wheel, thereby causing the printing wheel to print patterns and words on the underside of the tape being dispensed.

The aforesaid ink supplying device is still not satisfactory in function. When the roller-like ink soaking member soaked up ink in the saturated status, excessive amount of ink may be applied to the periphery of the printing wheel, resulting in poor printing quality. Further, because the roller-like ink soaking member cannot keep ink wet for long, ink soaked up by the roller-like ink soaking member easily changes into vapor, resulting in unclear or thin printing on the tape being dispensed. In general, the use of the aforesaid ink supplying device makes printing quality control difficult.

SUMMARY OF THE INVENTION

The present invention has been accomplished to provide a tape dispenser having printing means for printing the tape being dispensed, which applies ink to the printing surface of the printing wheel evenly to achieve a high quality printing effect.

It is another object of the present invention to provide a tape dispenser having printing means for printing the tape being dispensed, which keeps ink from changing into vapor quickly.

It is still another object of the present invention to provide a tape dispenser having printing means for printing the tape being dispensed, which is durable in use and, achieves a high printing quality.

To achieve these objects of the present invention, the tape dispenser comprises a main body; a tape roll holder mounted on the main body to hold a tape roll such that the tape roll can be turned; a tape cutter mounted on the main body; a printing wheel fastened pivotally with the main body; an ink supply unit located on the main body, the ink supplying unit comprising an ink supply device adapted to apply ink to the periphery of the printing wheel. The printing wheel comprises a printing wheel body formed in integrity of hard material. The printing wheel body has a cylindrical base, and a plurality of protruded portions raised from the periphery of the cylindrical base and forming a printing surface around the periphery of the cylindrical base. The printing surface is coaxial to the cylindrical base. The ink supplying device comprises a housing detachably mounted on the main body for receiving ink therein, a porous ink soaking layer mounted inside the housing and adapted to soak the ink, and a fabric ink applying layer covered on the porous ink soaking layer and partially exposed to the outside of the housing. The fabric ink applying layer is disposed in contact with the periphery of the printing wheel at one side when the ink supplying device installed in the main body.

The printing wheel is made by using a programmable engraving machine to engrave a hard cylindrical base material into the desired finished product subject to a predetermined design. Because the printing surface is formed integral with the hard cylindrical base material, the printing surface does not drop from the printing wheel body. Because the protruded portions (printing surface) of the printing wheel body are a part of the circumference of the cylindrical base material before engraving, the finally finished printing surface has a good roundness that can be closely attached to the underside of the adhesive tape being dispensed to achieve a high quality printing. Because the printing wheel is made of hard material (for example, aluminum), the printing surface does not deform during printing, and fine patterns of the design of the printing surface can be clearly printed on the adhesive tape being dispensed. Further, because the printing surface is formed integral with in the periphery of printing wheel, the design of the printing surface has no interruption in it.

DETAILED DESCRIPTION OF THE PREFERRED EMBODIMENT

Figure 1:
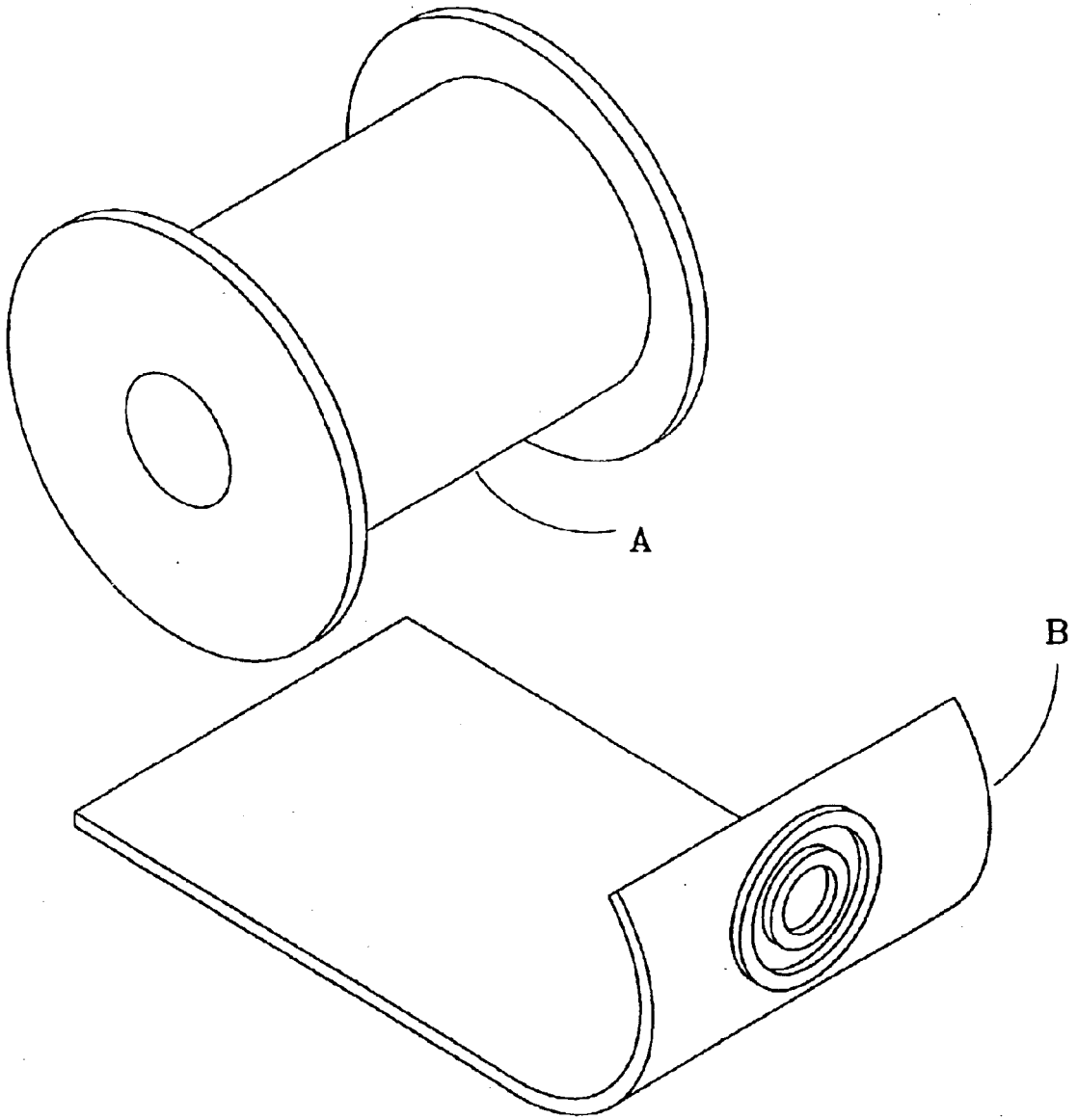
FIG. 1 PRIOR ART
FIG. 1 is an exploded view of a printing wheel for tape dispenser according to the prior art.
Figure 2:
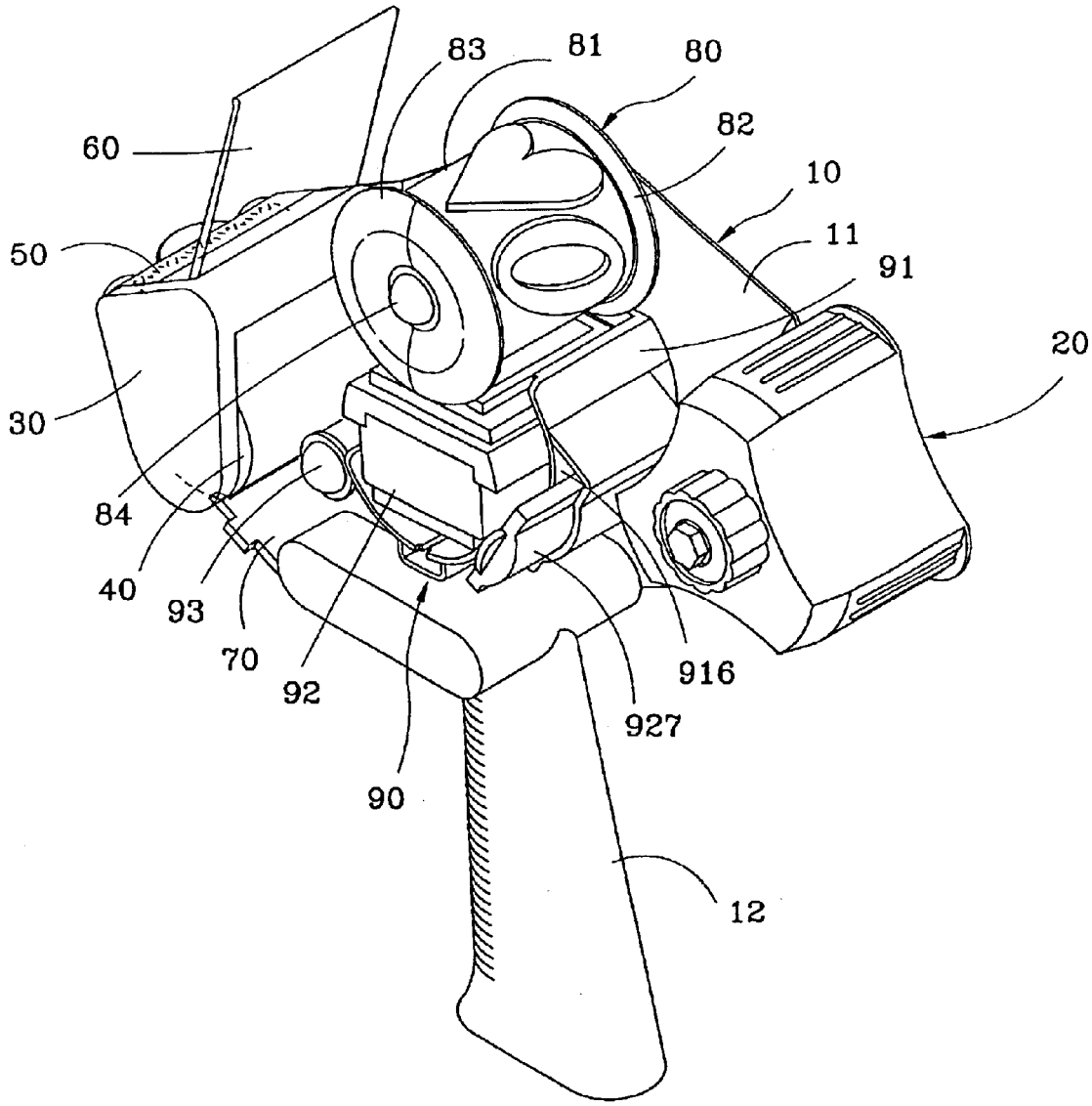
FIG. 2 is a perspective assembly view of a tape dispenser according to the present invention.
Figure 3:
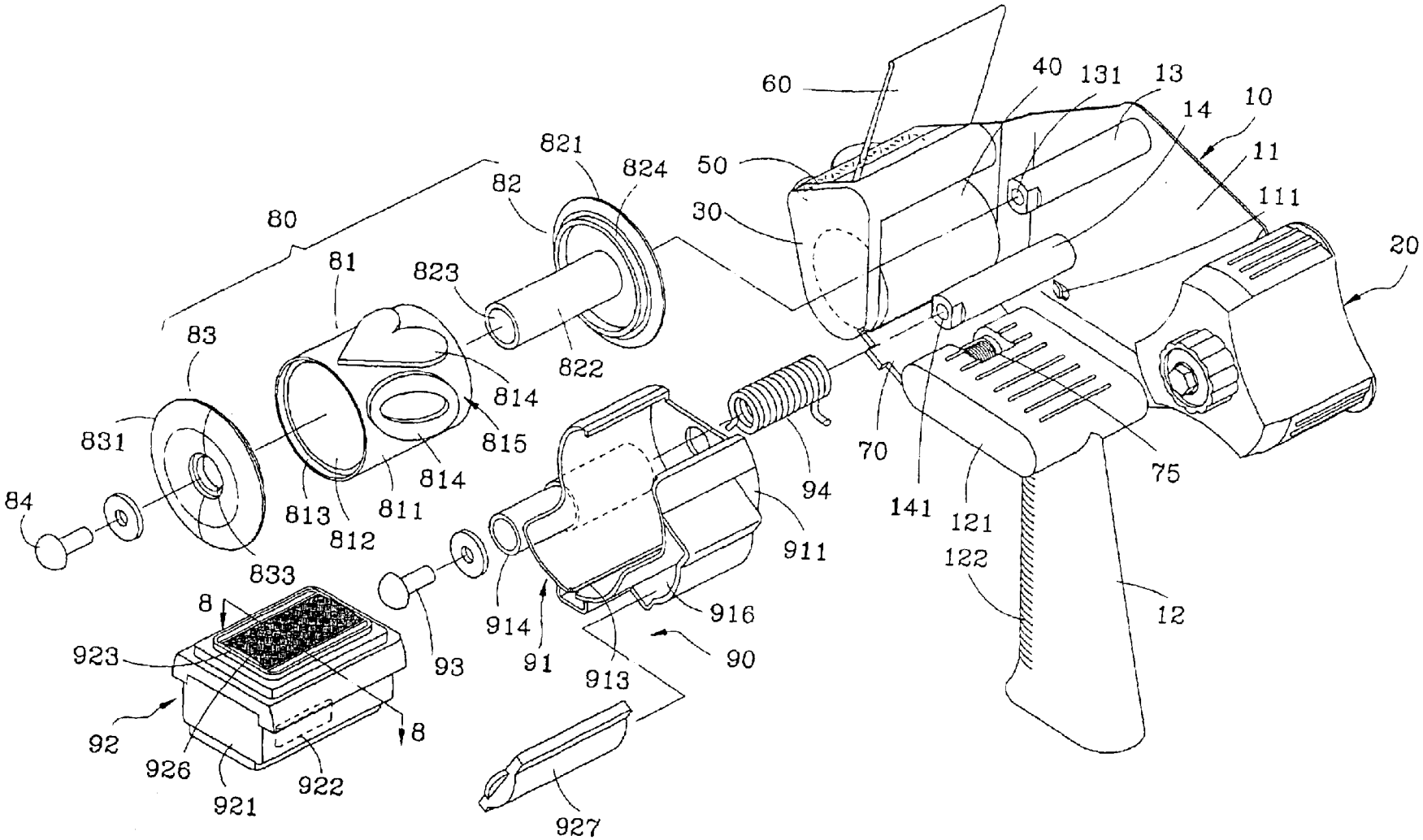
FIG. 3 is an exploded view of the tape dispenser according to the present invention.
Figure 4:
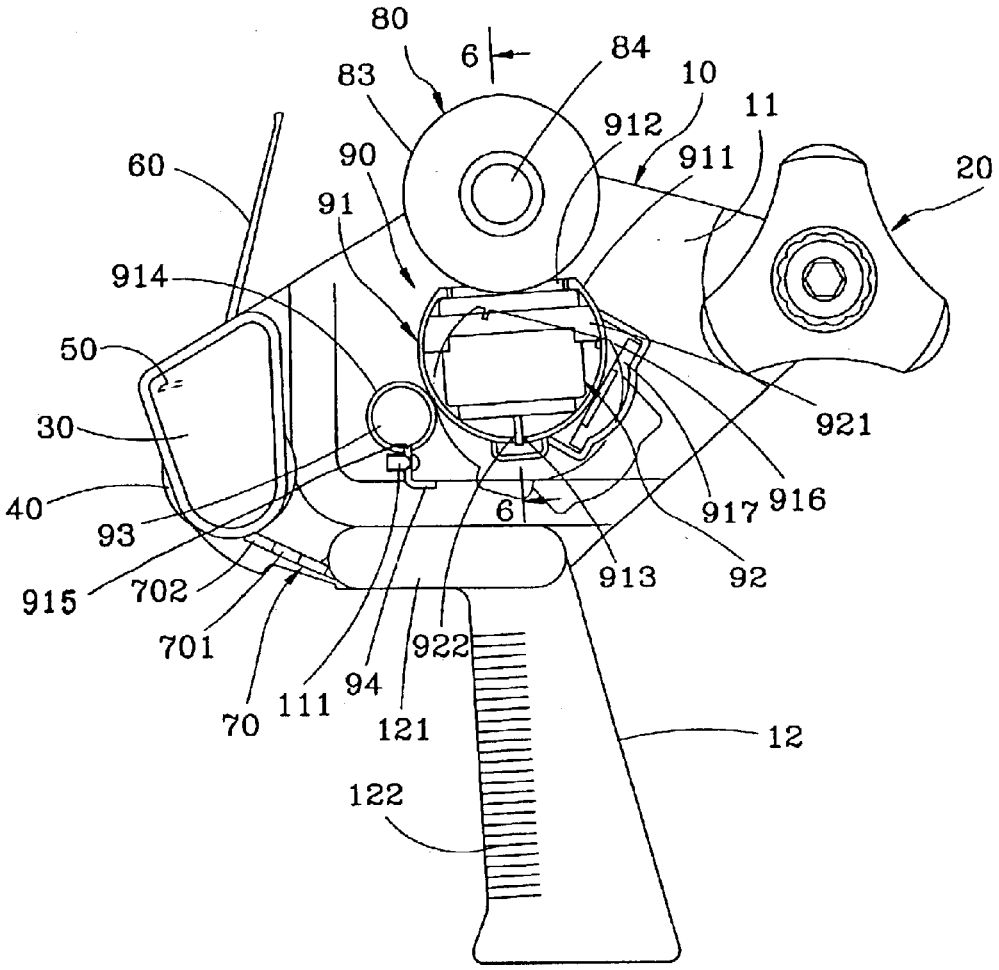
FIG. 4 is a side plain view of the tape dispenser according to the present invention.

Referring to FIGS. 2~4, a tape dispenser having printing means for printing the tape being dispensed in accordance with the present invention is a handheld tape dispenser comprised of a main body 10, tape roll holder 20, a front casing 30, a tape-transfer cylinder 40, a tape cutter 50, an applicator plate 60, a press member 70, a printing wheel 80, and an ink supplying unit 90.

The main body 10 comprises a base panel 11 and a handle 12 provided at the bottom side of the base panel 11. The base panel 11 comprises a first axle (namely, the upper axle) 13 and a second axle (namely, the lower axle) 14 perpendicularly extended from the middle area of the inner side thereof in transverse direction at different elevations, and a protrusion 111 provided below the second axle 14. The axles 13 and 14 each have a screw hole 131 or 141 in the respective distal (free) end. The handle 12 comprises a mounting block 121 fixedly fastened to the inner side of the base panel 11 below the protrusion 111, and a hand grip 122 downwardly extended from the bottom side of the mounting block 121. The tape roll holder 20 is fastened rotatably with the rear end of the inner side of the base panel 11 of the main body 10, and adapted to hold a tape roll (not shown). The front casing 30 is fixedly fastened to the front end of the inner side of the base panel 11 of the main body 10 remote from the tape roll holder 20. The tape-transfer cylinder 40 is fastened rotatably with the inner side of the base panel 11 of the main body 10 in transverse direction, and suspended in the casing 30. The tape cutter 50 is mounted in the top side of the casing 30, and adapted to cut off the adhesive tape being dispensed. The applicator plate 60 is provided at the top side of the casing 30, and adapted to press the adhesive tape being dispensed on the package.

Figure 5:
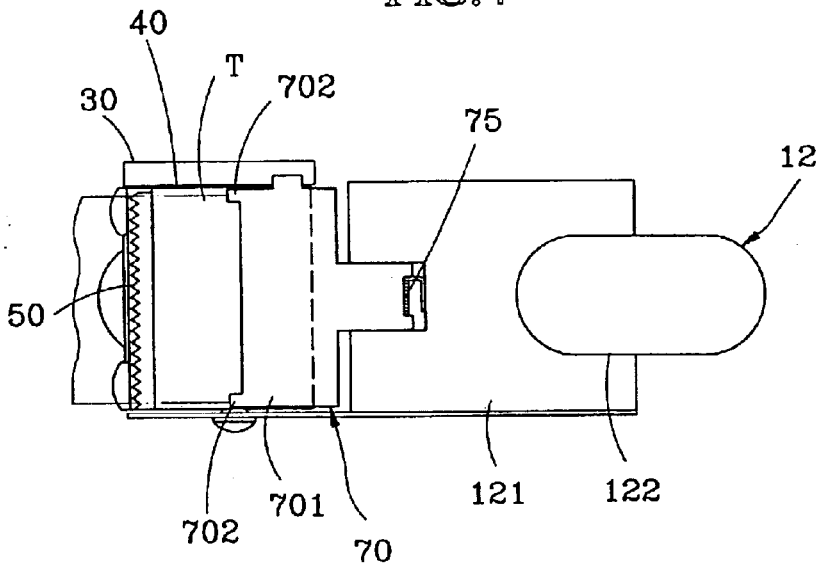
FIG. 5 is a bottom plain view of the front part of the tape dispenser according to the present invention.

Referring to FIG. 5 and FIG. 4 again, the press member 70 comprises a rectangular plate 701 approximately equal to the length of the tape-transfer cylinder 40. The rectangular plate 701 has two front press portions 702 bilaterally protruded from the front side thereof. The rear side of the rectangular plate 701 is fastened pivotally with the front side of the mounting block 121 of the handle 12. A torsional spring 75 is provided between the rectangular plate 701 and the mounting block 121 of the handle 12 to impart an upward biasing force to the rectangular plate 701, keeping the two front press portions 702 of the rectangular plate 701 slightly pressed on the periphery of the tape-transfer cylinder 40 at the bottom side (the objective will be described later).

Figure 6:
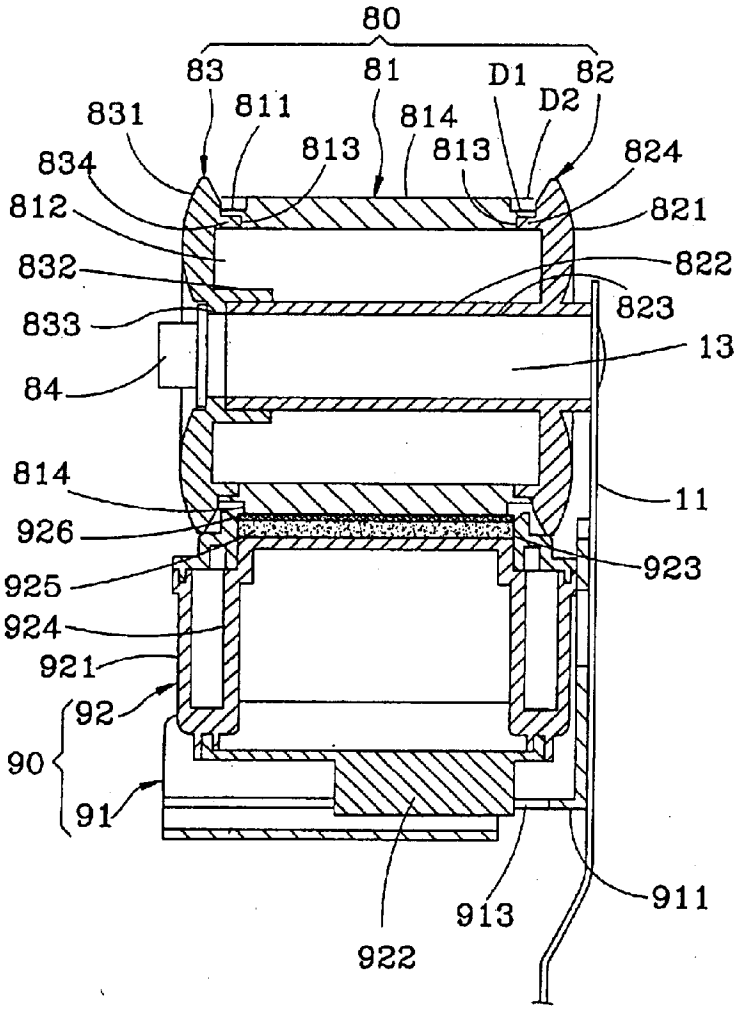
FIG. 6 is a sectional view taken along line 6—6 of FIG. 2.

Referring to FIG. 6 and FIGS. 3 and 4 again, the printing wheel 80 is comprised of a printing wheel body 81, a first end member 82, and a second end member 83. The printing wheel body 81 is a hollow cylindrical member made of aluminum (or any of a variety of hard materials including metal materials, acrylics, and etc.), having a cylindrical base 811, a through hole 812 axially extended through the two distal ends of the base 811, two inside annular coupling grooves 813 respectively disposed in the two ends of the base 811 around the through hole 812, protruded portions (patterns and words) 814 raised from the periphery D1 of the base 811 and forming a printing surface 815 around the periphery of the base 811. The protruded portions 814 have the same thickness so that the surface of the printing surface 815 is on the same (imaginary) circumference D2, which is coaxial to the base 811. The surface of the printing surface 825 is preferably a coarse surface to facilitate retaining of ink, so that a clear printing can be achieved. The first end member 82 comprises a disk 821, the disk 821 having a diameter greater than maximum outer diameter of the printing wheel body 81 (the diameter of the aforesaid imaginary circumference D2), a shaft 822 perpendicularly extended from the center of one side, namely, the inner side of the disk 821, an axial center hole 823 axially extended through the center of the shaft 822 and the disk 821, and an annular coupling flange 824 protruded from the inner side of the disk 821 and equally spaced around the shaft 822 and press-fitted into one inside annular coupling groove 813 of the base 811 of the printing wheel body 81. The second end member 83 comprises a disk 831, the disk 831 having an outer diameter equal to the disk 821 of the first end member 820, an axial center hole 833 axially extended through the center of the disk 831, a barrel 832 protruded from the inner side of the disk 831 around the axial center hole 833 and sleeved onto the free end of the shaft 822 of the first end member 82, and an annular coupling flange 834 protruded from the inner side of the disk 831 and equally spaced around the barrel 832 and press-fitted into one inside annular coupling groove 813 of the base 811 of the printing wheel body 81 opposite to the first end member 82.

The assembly process of the printing wheel 80 is outlined hereinafter with reference to FIGS. 2 and 6 again, insert the shaft 822 of the first end member 82 into the through hole 812 of the base 811 of the printing wheel body 81 to force the annular coupling flange 824 into one inside annular coupling groove 813 of the base 811 of the printing wheel body 81, keeping the disk 821 covered on one end of the printing wheel body 81, and then press-fit the annular coupling flange 834 of the second end member 83 into the other inside annular coupling groove 813 of the base 811 of the printing wheel body 81, keeping the barrel 832 sleeved onto the free end of the shaft 822 of the first end member 82. When assembled, the axial center hole 823 of the first end member 82 and the axial center hole 833 of the second end member 83 are axially aligned in the central axis of the printing wheel body 81 in communication with each other. The printing wheel 80 is then fastened pivotally with the base panel 11 of the main body 10 by: coupling the axial center hole 823 of the first end member 82 and the axial center hole 833 of the second end member 83 to the first axle 13 of the base panel 11, and then fastening a screw bolt 84 to the screw hole 131 of the first axle 13 to secure the printing wheel 80 to the main body 10.

The printing wheel body 81 is made by using a programmable engraving machine to engrave the periphery of a cylindrical aluminum base material into the desired finished product subject to the design of a predetermined plain mother pattern drawing. It is to be understood that the circumference of the cylindrical aluminum base material is the aforesaid circumference D2 of the printing surface 815. According to the preferred embodiment of the present invention, the two end members 82 and 83 are separately made, and then fastened to each other and secured to the printing wheel body 81 at two sides. Alternatively, two end disks can be directly formed on the two ends of the engraved cylindrical base material. After formation of the printing surface 815, the printing wheel body 81 is coarsened by means of the application of a sand blasting equipment, so that the printing surface 815 can retain ink and transfer retained ink to the adhesive tape being dispensed.

Referring to FIGS. 3 and 4 again, the ink supplying unit 90 is comprised of a rack 91, an ink supplying device 92, and a torsional spring 94. The rack 91 comprises a cup-like frame base 911, a barrel 914 fixedly provided at one lateral side of the cup-like frame base 911, and a flat receiving chamber 916 located on the other lateral side of the cup-like frame base 911 opposite to the barrel 914. The cup-like frame base 911 has an opening 912 in the periphery at the top side, and an elongated mounting slot 913 in the periphery at the bottom side. The barrel 914 is sleeved onto the second axle 14 of the main body 10, for enabling the rack 91 to be turned about the second axle 14. Further, the barrel 914 has a locating hole 915. A screw bolt 93 is threaded into the screw hole 141 of the second axle 14 to secure the rack 91 to the second axle 14. When installed, the cup-like frame base 911 is disposed below the printing wheel 80, and the opening 912 of the cup-like frame base 911 is kept facing the printing surface 815 of the printing wheel body 81 of the printing wheel 80. The torsional spring 94 is mounted within the barrel 914 around the second axle 14, having one end fastened to the locating hole 915 of the barrel 914 and the other end extended to the outside of the barrel 914 and fastened to the protrusion 111 of the base panel 11 of the main body 10. The torsional spring 94 imparts a biasing force to the rack 91 to force the cup-like frame base 911 of the rack 91 toward the printing wheel 80.

Figure 7:
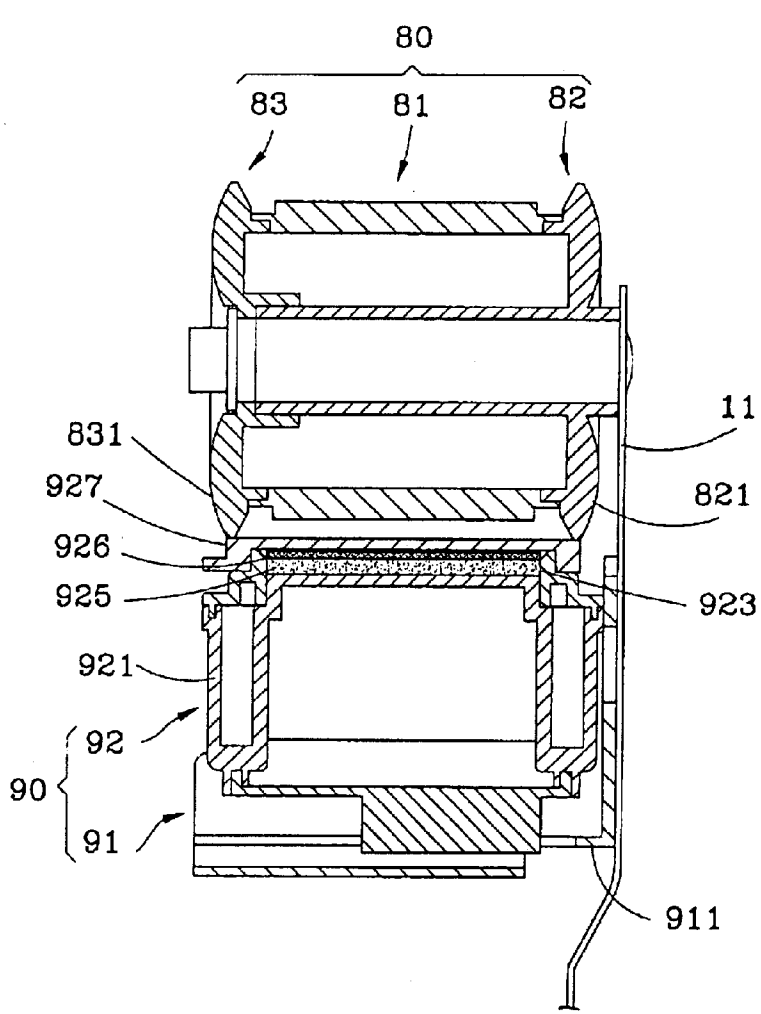
FIG. 7 is similar to FIG. 6 but showing the top cover of the ink supplying device closed.
Figure 8:
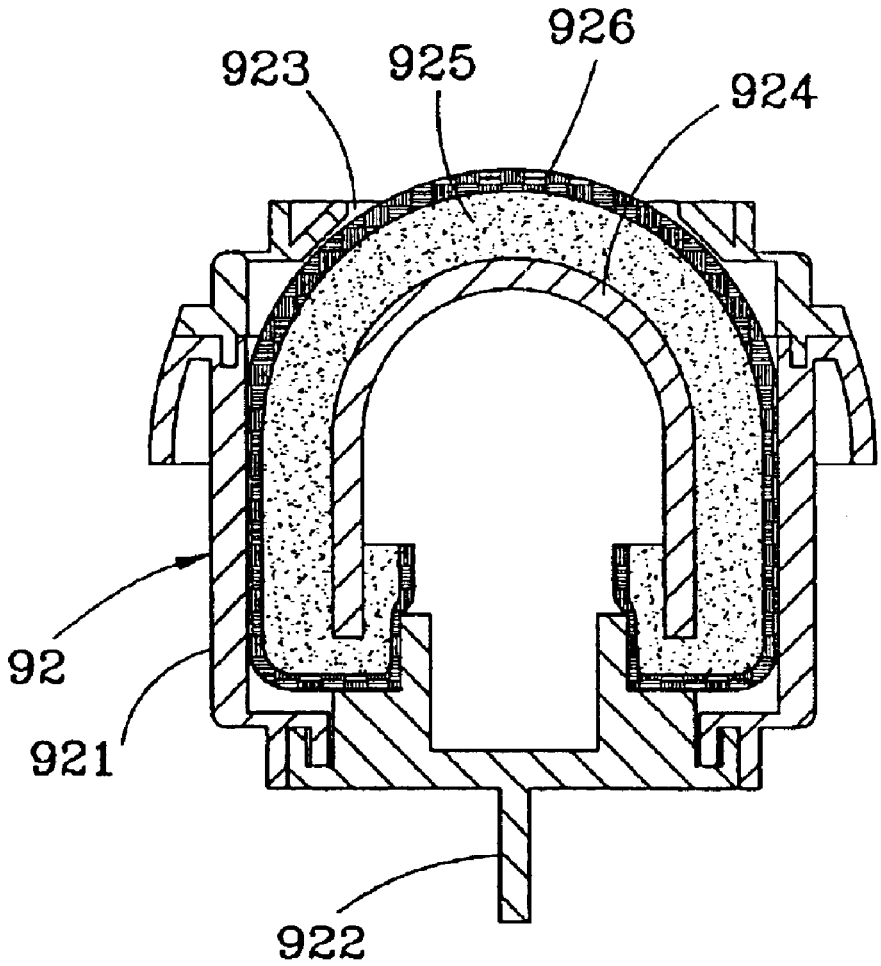
FIG. 8 is a sectional view taken along line 8—8 of FIG. 3.

Referring to FIGS. 7 and 8 and FIGS. 2, 3, and 6 again, the ink supplying device 92 comprises a housing 921, a porous ink soaking layer 925, a fabric ink applying layer 926, and a top cover 927. The housing 921 is shaped like a rectangular box having a top opening 923, a round arch-like inner shell 924 suspended on the inside, and a bottom mounting flange 922. The porous ink soaking layer 925 is piece of absorptive non-woven fabrics (for example, felt) mounted within the housing 921 and closely covered on the round arch-like inner shell 924, keeping the two distal ends thereof fixed to the bottom side of the housing 921.The fabric ink applying layer 926 is a piece of velvet closely attached to the outer surface of the ink soaking layer 925, keeping the two distal ends thereof fixed to the bottom side of the housing 921. The center area (the top area) of the fabric ink applying layer 926 protrudes through the top opening 923 over the top side of the housing 921. The ink supplying device 92 is mounted inside the cup-like frame base 911 of the rack 91 by plugging the bottom mounting flange 922 of the housing 921 into the elongated mounting slot 913 of the cup-like frame base 911 of the rack 91. Because the torsional spring 94 imparts a biasing force to the cup-like frame base 911 toward the printing wheel body 81 of the printing wheel 80, the fabric ink applying layer 926 is maintained in contact with the printing surface 815 of the printing wheel body 81 of the printing wheel 80 (see FIG. 6). When not in use, the top cover 927 is closed on the top opening 923 of the housing 921 (see FIG. 7). At this time, the two ends of the top side of the top cover 927 is stopped at the bottom sides of the disks 821 and 831 of the end members 82 and 83 of the printing wheel 80 without touching the printing surface 815 of the printing wheel body 81. When removed from the housing 921, the top cover 927 can be received in the receiving chamber 916 of the rack 91 (see FIGS. 2 and 3).

The use and functioning of the tape dispenser are described hereinafter. When not in use, the top cover 927 of the ink supplying device 92 is closed on the top opening 923 of the housing 921 to prevent quick drying of ink. When in use, the top cover 927 is removed from the housing 921, and then received in the receiving chamber 916 of the rack 91. Before use, check the ink containing status of the ink supplying device 92, If it is necessary to refill the ink supplying device 92 with ink, pull the cup-like frame base 911 of the rack 91 downwards against the spring power of the torsional spring 94 (see the imaginary line shown in FIG. 4), and then remove the ink supplying device 92 from the rack 91, and then drip a proper amount of ink onto the fabric ink applying layer 926 in the top opening 923 of the housing 921 of the ink supplying device 92, for enabling supplied ink to be absorbed by the ink soaking layer 925, and then load the ink supplying device 92 in the cup-like frame base 911 of the rack 91 again. When released the hand from the rack 91 after loading of the ink supplying device 92 in the cup-like frame base 911, the rack 91 is returned to its former position, keeping thee fabric ink applying layer 926 in close contact with the printing surface 815 of the printing wheel body 81 of the printing wheel 80 (see FIG. 6). Further, the lead end of the adhesive tape roll (not shown) carried on the tape holder 20 is pulled out, and extended over the top side of the printing wheel 80 and the bottom side of the tape-transfer cylinder 40 to the tape cutter 50. Please refer to FIG. 5. The two front press portions 702 of the rectangular plate 701 of the press member 70 are slightly pressed on the adhesive tape T against the periphery of the tape-transfer cylinder 40. When applying the adhesive tape T to seal a carton or the like, the printing wheel 80 is rotated by the forwardly dispensed adhesive tape T over the fabric ink applying layer 926 in the top opening 923 of the housing 921 of the ink supplying device 92, and therefore the printing surface 815 is continuously covered with ink and printing the underside of the adhesive tape T being dispensed.

As indicated above, the tape dispenser having printing means for printing the tape being dispensed has the features and advantages as follows:

1. The ink supplying device 92 uses the absorptive non-woven fabrics of ink soaking layer 925 to retain ink in the saturated status. The porous structure of the absorptive non-woven fabrics (felt) of ink soaking layer 925 enables the ink soaking layer 925 to be filled with ink completely and, keeps ink from changing into vapor. Further, the fabric ink applying layer 926 slows down ink drying speed, and can be gently maintained in close contact with the printing surface 815 of the printing wheel body 81 of the printing wheel 80, enabling ink to be evenly applied to the printing surface 815 of the printing wheel body 81 of the printing wheel 80 to achieve a high quality printing effect.
2. Because the protruded portions 814 (printing surface 815) of the printing wheel body 81 are a part of the circumference of the cylindrical aluminum base material before engraving, the finally finished printing surface 815 has a good roundness that can be closely attached to the underside of the adhesive tape being dispensed to achieve a high quality printing.
3. Because the printing wheel body 81 is made of hard material (for example, aluminum), the printing surface 815 does not deform during printing, and fine patterns of the design of the printing surface 815 can be clearly printed on the adhesive tape being dispensed.

4. Because the printing surface 815 is formed integral with the periphery of the printing wheel body 81, the design of the printing surface 815 has no interruption in it.
5. Because the printing surface 815 is formed integral with the base 811, the printing surface 815 does not drop from the base 811, and the printing wheel body 81 is durable in use.

While only one embodiment of the present invention has been shown and described, it will be understood that various modifications and changes could be made thereunto without departing from the spirit and scope of the invention disclosed. For example, the tape dispenser can be made in the form of a tape-top type instead of the aforesaid handheld type.

What the invention claimed is:

1. A tape dispenser comprising:

a main body;

a tape roll holder mounted on said main body for holding a tape roll thereon;

a tape cutter mounted on said main body;

a printing wheel fastened rotatably with said main body;

an ink supply unit located on said main body for supplying ink to said printing wheel;

wherein said printing wheel comprises a printing wheel body formed in integrity of hard material, said printing wheel body having a cylindrical base and a plurality of protruded portions raised from the periphery of said cylindrical base and directly forming a printing surface around the periphery of said cylindrical base, said printing surface being coaxial to said cylindrical base;

wherein said ink supplying unit comprises a housing detachably mounted on said main body for receiving ink therein, a porous ink soaking layer mounted inside said housing and adapted to soak the ink, and a fabric ink applying layer covered on said porous ink soaking layer and being disposed in contact with the periphery of said printing wheel at one side thereof when said ink supplying unit is installed in said main body; and wherein said housing of said ink supplying unit is a box-like hollow member having a top opening in a top side thereof, and a round arch-like inner shell disposed on the inside and adapted to support said porous ink soaking layer and said fabric ink applying layer inside said housing and to keep a part of said fabric ink applying layer exposed to the outside of said housing through said opening; said ink supplying unit further comprises a top cover adapted to close the top opening of said housing.

2. The tape dispenser as claimed in claim 1, wherein said printing wheel further comprises a first disk and a second disk coaxially located on two distal ends of said cylindrical base.

3. The tape dispenser as claimed in claim 2, wherein said cylindrical base has an axially extended center through hole; said first disk has a shaft perpendicularly extended from the center of one side thereof and inserted into the axially extended center through hole of said cylindrical base; said second disk has a barrel perpendicularly extended from the center of one side thereof and inserted into the axially extended center through hole of said cylindrical base and press-fitted onto the end of said shaft of said first disk remote from said first disk.

4. The tape dispenser as claimed in claim 3, wherein said main body comprises an axle, said axle having a screw hole in an outer end thereof for the mounting of a screw bolt to secure said printing wheel to said main body for enabling said printing wheel to be rotated on the axle of said main body; said printing wheel has an axial hole axially extended through the shaft of said first disk and the barrel of said second disk and coupled to the axle of said main body for enabling said printing wheel to be rotated on the axle of said main body.

5. The tape dispenser as claimed in claim 1, wherein said printing surface of said printing wheel has a coarsened surface.

6. The ink dispenser as claimed in claim 1, wherein said main body comprises a base panel, a handle located on a bottom side of said base panel, a front casing located on a front side of said base panel, a tape-transfer cylinder fastened rotatably with said base panel inside said front casing, a press member provided below said tape-transfer cylinder, said press member having a rectangular plate, said rectangular plate having a rear side fastened pivotally with a top front side of said handle and two front press portions bilaterally protruded from a front side thereof, and a torsional spring provided between the rear side of said rectangular plate and said handle to impart a torsional force to said rectangular plate such that the two front press portions of said rectangular plate are pressed on the periphery of said tape-transfer cylinder at a bottom side thereof; said tape cutter is provided at a front side of said front casing of said main body; said tape roll holder and said printing wheel and said ink supplying unit are mounted on an inner side of said base panel of said main body.

7. The ape dispenser as claimed in claim 1, wherein said ink supplying unit further comprises a rack, said rack having a cup-like frame base fastened pivotally with said main body, said cup-like frame base having an opening, and a torsional spring provided between said cup-like frame base and said main body to impart a torsional force to said cup-like frame base such that the opening of said cup-like frame base is maintained facing the periphery of said printing wheel; said housing of said ink supplying device is detachably mounted in said cup-like frame base for enabling said fabric ink applying layer to be partially extended out of the opening of said cup-like frame base into contact with the periphery of said printing wheel.

8. The tape dispenser as claimed in claim 1, wherein said cup-like frame base has a receiving chamber provided at one side of the periphery thereof and adapted to receive said top cover of said ink supplying unit.

9. The tape dispenser as claimed in claim 1, wherein said porous ink soaking layer is made of non-woven fabrics.

* * * * *